US009518589B2

(12) United States Patent
Ward

(10) Patent No.: US 9,518,589 B2
(45) Date of Patent: Dec. 13, 2016

(54) VANE PACK ASSEMBLY FOR VTG TURBOCHARGERS

(71) Applicant: BorgWarner Inc., Auburn Hills, MI (US)

(72) Inventor: Daniel N. Ward, Asheville, NC (US)

(73) Assignee: BorgWarner Inc., Auburn Hills, MI (US)

( * ) Notice: Subject to any disclaimer, the term of this patent is extended or adjusted under 35 U.S.C. 154(b) by 298 days.

(21) Appl. No.: 14/395,558

(22) PCT Filed: Apr. 11, 2013

(86) PCT No.: PCT/US2013/036097

§ 371 (c)(1),
(2) Date: Oct. 20, 2014

(87) PCT Pub. No.: WO2013/162899

PCT Pub. Date: Oct. 31, 2013

(65) Prior Publication Data

US 2015/0118038 A1 Apr. 30, 2015

Related U.S. Application Data

(60) Provisional application No. 61/637,389, filed on Apr. 24, 2012.

(51) Int. Cl.

| | |
|---|---|
| ***F04D 27/00*** | (2006.01) |
| ***F04D 29/30*** | (2006.01) |
| ***F01D 17/16*** | (2006.01) |

(52) U.S. Cl.

CPC ..... *F04D 29/30* (2013.01); *F01D 17/165* (2013.01); *F04D 27/002* (2013.01); *F02M 26/05* (2016.02); *F02M 26/10* (2016.02); *F05D 2220/40* (2013.01); *Y10T 29/49321* (2015.01)

(58) Field of Classification Search

CPC ..... F01D 17/165; F04D 27/002; F04D 29/30; F02M 26/05; F02M 26/10; F05D 2220/40; Y10T 29/49321

See application file for complete search history.

(56) References Cited

U.S. PATENT DOCUMENTS

| | | | | |
|---|---|---|---|---|
| 3,232,581 A * | 2/1966 | Swearingen | ..... | F01D 17/165 415/147 |
| 3,495,921 A * | 2/1970 | Swearingen | ..... | F01D 17/165 415/163 |
| 4,300,869 A | 11/1981 | Swearingen | | |
| 4,504,190 A * | 3/1985 | Beeloo | ..... | F01D 17/167 415/166 |

(Continued)

*Primary Examiner* — Igor Kershteyn

(74) *Attorney, Agent, or Firm* — A. Michael Tucker; Stephan A. Pendorf; Patent Central LLC

(57) ABSTRACT

A vane pack assembly is provided that can remove the spacers between the upper and lower vane rings to a location outside of the exhaust flow through the vane ring. In particular, the spacers are located within the vanes. Further, the assembly can effectively retain the small blocks used in varying the angle of the vanes on their associated vane pivot posts. A vane pack with such a configuration can use inexpensive parts, eliminate the need for welding of the vane pack and/or simplify the vane pack assembly process. Further, the vane pack can be decoupled from the turbine housing, thereby avoiding problems with differential thermal expansion.

16 Claims, 6 Drawing Sheets

(56) References Cited

U.S. PATENT DOCUMENTS

| | | | | |
|---|---|---|---|---|
| 4,702,672 | A * | 10/1987 | Leicht | F01D 17/165 415/164 |
| 7,059,129 | B2 * | 6/2006 | Zollinger | F01D 17/165 415/160 |
| 7,137,778 | B2 | 11/2006 | Marcis et al. | |
| 2002/0094284 | A1 | 7/2002 | Arnold | |
| 2006/0188367 | A1 * | 8/2006 | Sterner | F01D 17/165 415/191 |
| 2010/0008774 | A1 | 1/2010 | Scholz et al. | |
| 2011/0110768 | A1 | 5/2011 | Nikolic et al. | |

* cited by examiner

VANE PACK ASSEMBLY FOR VTG TURBOCHARGERS

FIELD OF THE INVENTION

Embodiments related in general to turbochargers and, more particularly, to vane packs for variable turbine geometry turbochargers.

BACKGROUND OF THE INVENTION

Turbochargers are a type of forced induction system. They deliver air, at greater density than would be possible in the normally aspirated configuration, to the engine intake, allowing more fuel to be combusted, thus boosting the engine's horsepower without significantly increasing engine weight. A smaller turbocharged engine, replacing a normally aspirated engine of a larger physical size, will reduce the mass and can reduce the aerodynamic frontal area of the vehicle.

Referring to FIG. 1, a turbocharger (10) uses the exhaust flow from the engine exhaust manifold to drive a turbine wheel (12), which is located in a turbine housing (14) to form a turbine stage (16). The energy extracted by turbine wheel (12) is translated into a rotating motion which then drives a compressor wheel (18), which is located in a compressor cover (20), to form a compressor stage (22). The compressor wheel (18) draws air into the turbocharger (10), compresses this air, and delivers it to the intake side of the engine. The turbocharger (10) has an associated axis (11).

Variable Geometry turbochargers typically use a plurality of rotatable vanes (24) to control the flow of exhaust gas, which impinges on the turbine wheel (12) and controls the power of the turbine stage (16). These vanes (24) also therefore control the pressure ratio generated by the compressor stage (22). In engines, which control the production of NOx by the use of High Pressure Exhaust Gas Recirculation (HP EGR) techniques, the function of the vanes (24) in a VTG also provides a means for controlling and generating exhaust back pressure.

An array of pivotable vanes (24) is located between a generally annular upper vane ring (UVR) (26) and a generally annular lower vane ring (LVR) (28). Each vane rotates on a pair of opposing axles (30) (FIGS. 2A and 2B), protruding from said vane (24) with the axles on a common axis. Each axle (30) is located in a respective aperture in the LVR (20) and a respective aperture in the UVR (30). The angular orientation of the UVR (26), relative to the LVR (20), is set such that the complementary apertures in the vane rings (26, 28) are concentric with the axis of the axles (30) of the vane (24), and the vane (24) is free to rotate about the axis (32) of the two axles (30), which is concentric with the now established centerline of the two apertures. Each axle (30) on the UVR side of the vane (24) protrudes through the UVR (26) and is affixed to a vane arm (34), which controls the rotational position of the vane (24) with respect to the vane rings (26, 28). Typically, there is a separate ring which controls all of the vane arms (34) in unison via small sliding blocks (48). This unison ring (50) is controlled by an actuator which is operatively connected to rotate the unison ring (50). The actuator is typically commanded by the engine electronic control unit (ECU). The assembly consisting of the plurality of vanes (24) and the two vane rings (26, 28) is typically known as the vane pack. Typically there is a separate ring which controls all of the vane arms in unison via small sliding blocks (48).

Because the turbine housing (14) is not symmetrically round in a radial plane, and because the heat flux within the turbine housing (14) is also not symmetrical, the turbine housing (14) is subject to asymmetric stresses and asymmetric thermal deformation.

The clearance between the rotatable vanes (24), more specifically between the cheeks (36) of the vanes (24) and the inner surfaces (38, 40) of the upper and lower vane rings (26, 28), is a major contributor to a loss of efficiency in both the control of exhaust gas allowed to impinge on the turbine wheel (12) and in the generation of backpressure upstream of the turbine wheel (12). The clearances between the vane side cheeks (36) and the complementary inner surfaces (38, 40) of the vane rings (26, 28) are kept to a minimum to increase the efficiency of the vane pack.

Unfortunately, the increase in efficiency due the side clearances is inversely proportional to the propensity of the vane pack to wear, stick, or completely jam due to thermal deformation in the turbine housing (14) being transferred to the vane pack. Thus, the vane pack needs to be accurately placed and constrained within the turbine housing (14) in a manner which minimizes the transference of thermally induced distortion. While internal to the vane pack, the aforementioned clearances can be sized to maximize efficiency while minimizing the potential for sticking, jamming, and wear.

In some VTGs, as depicted in FIG. 2B, the upper vane ring (UVR) (26) and the lower vane ring (LVR) (28) are held together by studs or bolts (42), sometimes with nuts (44), which serve to apply a clamp load on the vane rings (26, 28), and on a plurality of spacers (46) placed between the vane rings (26, 28), such that the length of the spacer (46) determines the distance between the UVR (26) and the LVR (28), and thus the clearance between the cheeks (36) of the vanes (24) and the inner surfaces (38, 40) of the vane rings (26, 28). The bolts or studs (42) also serve to provide the angular orientation of the apertures in which the axles (30) of the vanes (24) are constrained. When studs are used, quite often the stud is screwed into the turbine housing (14), and the vane pack is assembled directly onto the turbine housing (14). However, studs are difficult to secure so that they do not unscrew with vibration, especially in situations where there are high temperatures (from 740° C. to 1050° C.). Similarly, in a situation where the temperature can range from below freezing to high combustion-like temperatures (from 740° C. to 1050° C.), it is difficult to maintain clamp load under a nut so that the nut does not come loose due to the differences in coefficients of thermal expansion between the materials of the components in the clamp load set.

Additionally, when cylindrical spacers (46) are used to determine and maintain the spacing between the UVR (26) and the LVR (26), the flow of gas around these typically cylindrical spacers (46) causes an aerodynamic phenomenon called vortex shedding, in which the flow periodically separates from the downstream side of the cylinder in a make and break cycle which can build to a resonance in the flow. Vortex shedding can cause a potentially damaging aerodynamically induced cyclic vibration in the thin blades of the turbine wheel (12).

During the assembly of the vane pack, much effort is expended ensuring that the correct components are used in the correct orientation and that the correct clamp loads are applied. Transport of the loose assembly is always difficult as removal of the unison ring can allow the individual sliding blocks to change their orientation relative to the slots in the unison ring making it quite difficult to re-assemble.

In the typical VTG vane pack, the upper end of the vane axle (30) is welded to the vane arm (34), a process which is costly in terms of equipment and time. Because the parts involved (vanes and vane arms) must endure high temperature and often corrosive by-products of engine combustion, they are typically fabricated from high nickel exotic materials which must be welded in an inert atmosphere. In mass production, this welding process requires substantial capital equipment investment. Because all air must be purged from close proximity of the parts being welded the process is often quite time consuming, adding at least 90 seconds to the manufacturing time.

Thus, there is a need for a vane pack configuration that allows efficient assembly, handling, transport and/or installation into a turbine housing.

SUMMARY OF THE INVENTION

Embodiments herein are directed to a vane pack assembly that relocates the spacers which determines the distance between the vane rings. In particular, the spacer is relocated from within the exhaust flow to within the vanes where it hidden from the exhaust flow. A bolt or other fastener extends through the hollow spacer. This bolt can angularly orient the vane rings to each other, provide a pivot about which the vane can rotate, and provide a clamping mechanism to maintain the integrity of the vane pack during transportation to the assembly area. A vane pack configured according to embodiments herein can use inexpensive parts, eliminate the need for welding of the vane pack and/or simplify the vane pack assembly process.

BRIEF DESCRIPTION OF THE DRAWINGS

The present invention is illustrated by way of example and not limitation in the accompanying drawings in which like reference numbers indicate similar parts and in which.

DETAILED DESCRIPTION OF THE INVENTION

Arrangements described herein relate to a system and method for a vane pack assembly for a VTG turbocharger. Detailed embodiments are disclosed herein; however, it is to be understood that the disclosed embodiments are intended only as exemplary. Therefore, specific structural and functional details disclosed herein are not to be interpreted as limiting, but merely as a basis for the claims and as a representative basis for teaching one skilled in the art to variously employ the aspects herein in virtually any appropriately detailed structure. Further, the terms and phrases used herein are not intended to be limiting but rather to provide an understandable description of possible implementations. Arrangements are shown in FIGS. 4-7, but the embodiments are not limited to the illustrated structure or application.

Figure 1:
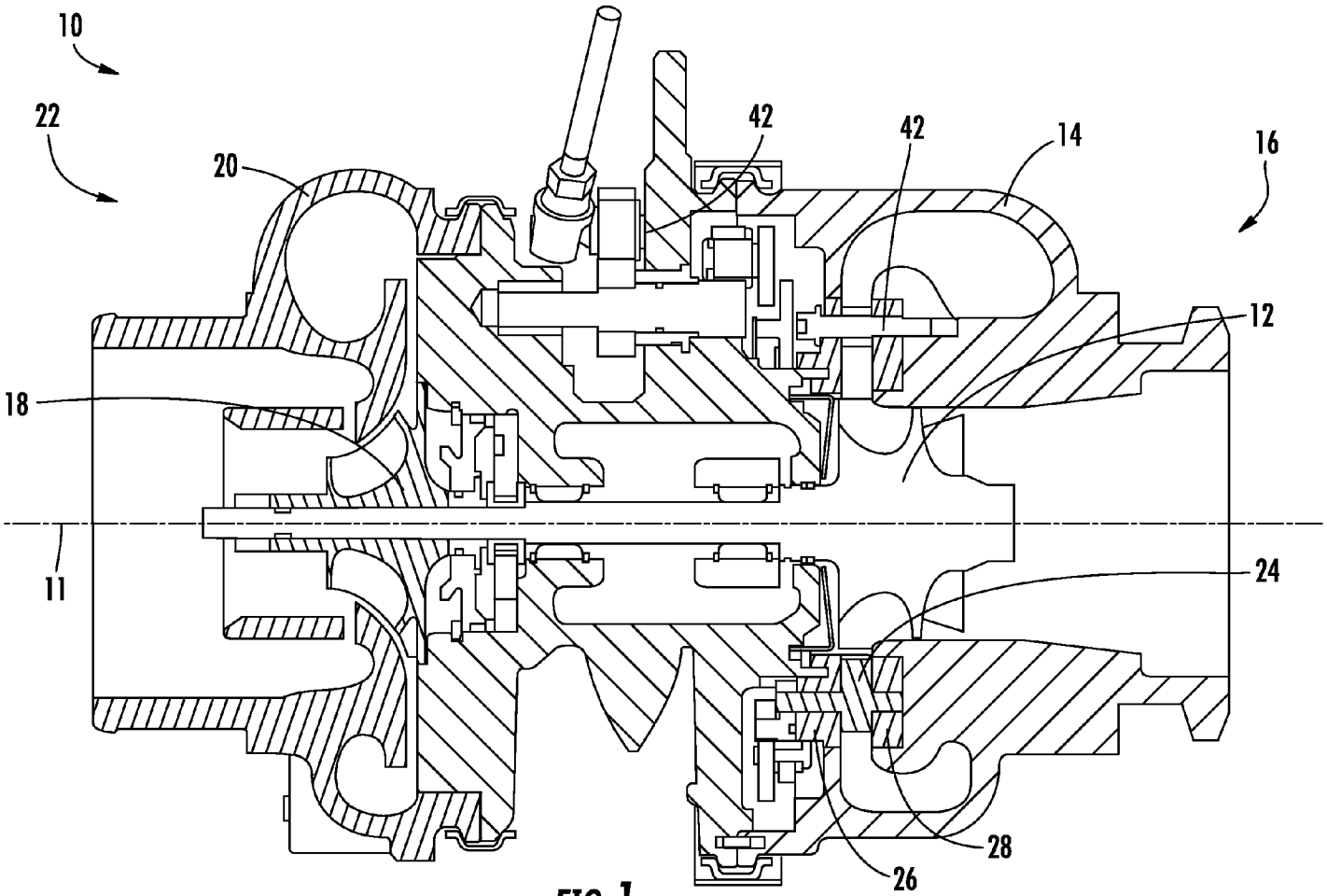
FIG. 1 (PRIOR ART)
FIG. 1 is a cross-sectional view of a typical variable geometry turbocharger.
Figure 2B:
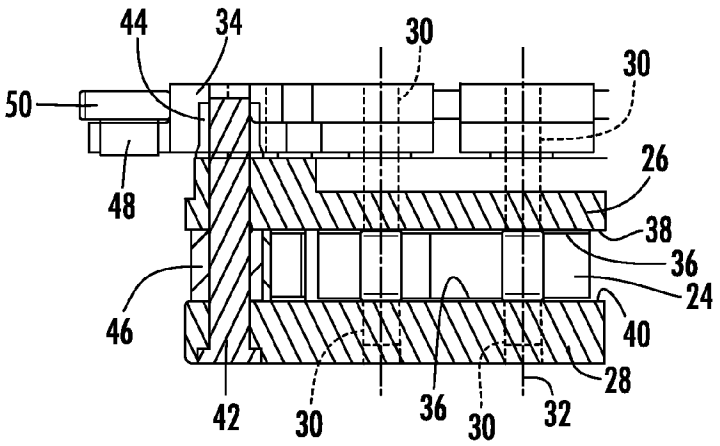
FIG. 2B (Prior Art)
FIG. 2B show a cross-sectional view of a typical vane pack, taken along line 2B-2B in FIG. 2A.
Figure 2A:
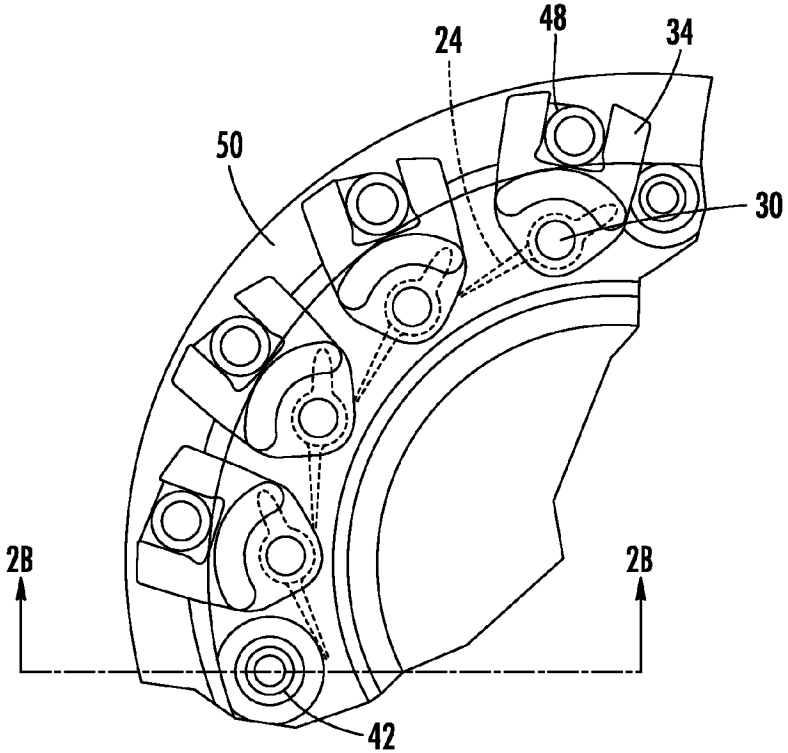
FIG. 2A (Prior Art)
FIG. 2A is a view of a portion of a typical vane pack.
Figure 4:
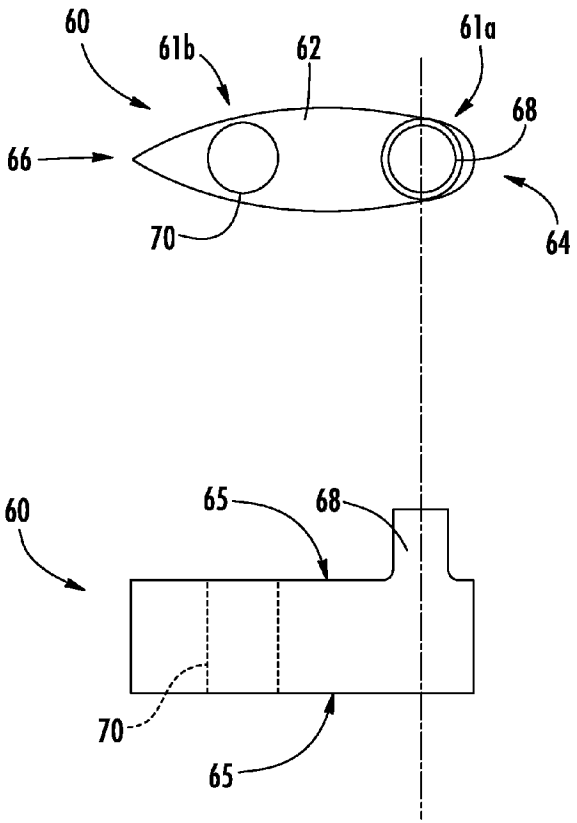
FIG. 4 shows an example of a vane configured according to embodiments herein.
Figure 3:
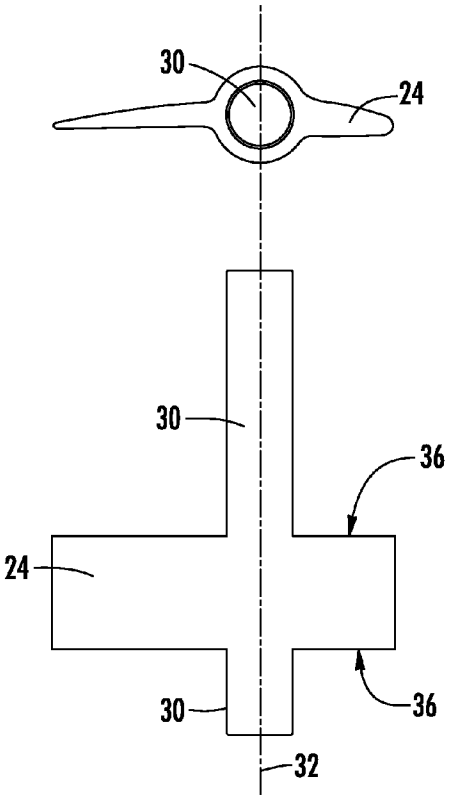
FIG. 3 (Prior Art)
FIG. 3 show top and side elevation views of a known vane.
Figure 5:
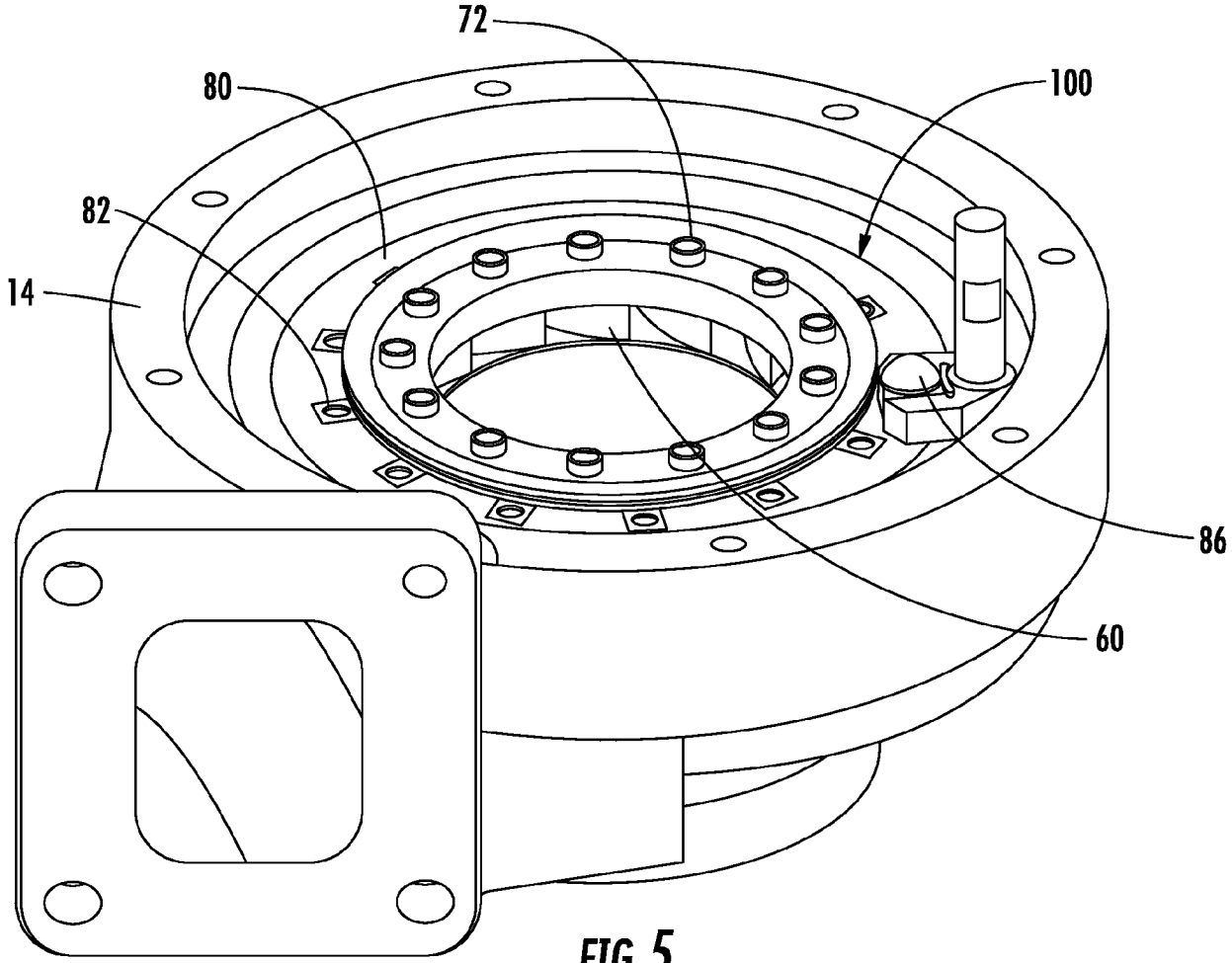
FIG. 5 shows a view of an assembled vane pack according to embodiments herein received within a turbine housing.

Referring to FIG. 4, an example of a vane (60) configured according to embodiments herein is shown. The vane (60) can have opposing cheek surfaces (65). The vane (60) can have a thicker body (62) than vanes currently in use, such as the one depicted in FIG. 3. The vane (60) can include a leading edge (64) and a trailing edge (66). The vane (60) can include a pair of pivots. A forward vane pivot (61*a*) can be provided near the leading edge (64), and can include a vane pivot post (68). The vane pivot post (86) can be similar to the vanes described in U.S. Pat. No. 7,137,778, which is incorporated herein by reference in its entirety. A rear vane pivot (61*b*) can be provided near the trailing edge (66) of the vane (60), and can include a bore (70).

Figure 6A:
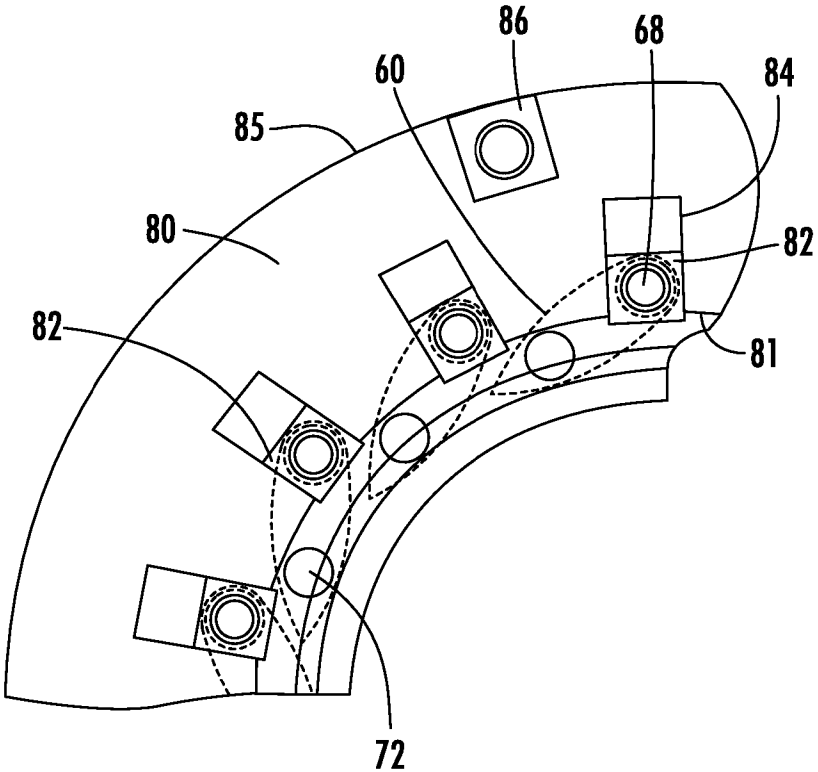
Figure 7B:
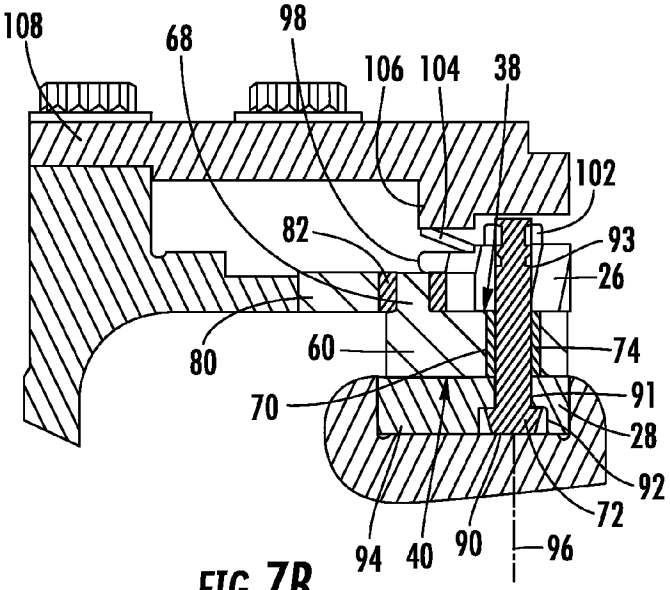
FIGS. 7A-B show sectional views of a portion of a vane pack assembly according to embodiments herein.

As is shown in FIG. 7B, a fastener, such as a bolt or post (72), can be received in the bore (70) along with a hollow spacer/bushing (74). The bolt (72) can secure the angular and radial location of the UVR (26) relative to the LVR (28). A unison ring (80) can drive a series of small sliding blocks (82), which can be fitted to the vane pivot posts (68) of the vanes (60). The unison ring (80) can have an inner peripheral surface (81), which can define an inner diameter thereof (see FIG. 6A). The unison ring (80) can also have an outer peripheral surface (85), which can define an outer diameter thereof (see FIG. 6A). Each of the sliding blocks (82) can rotate about the vane post (68) of a respective vane (60) and slide in a respective one of a plurality of slots (84) provided in the unison ring (80). In one embodiment, the slots (84) can open inwardly to the inner diameter of the unison ring (80). However, in another embodiment, the slots (84) can be located between the inner and outer diameter of the unison ring (80). The small sliding blocks (82) and the single large sliding block (86) are fitted to the unison ring (80).

Figure 6B:
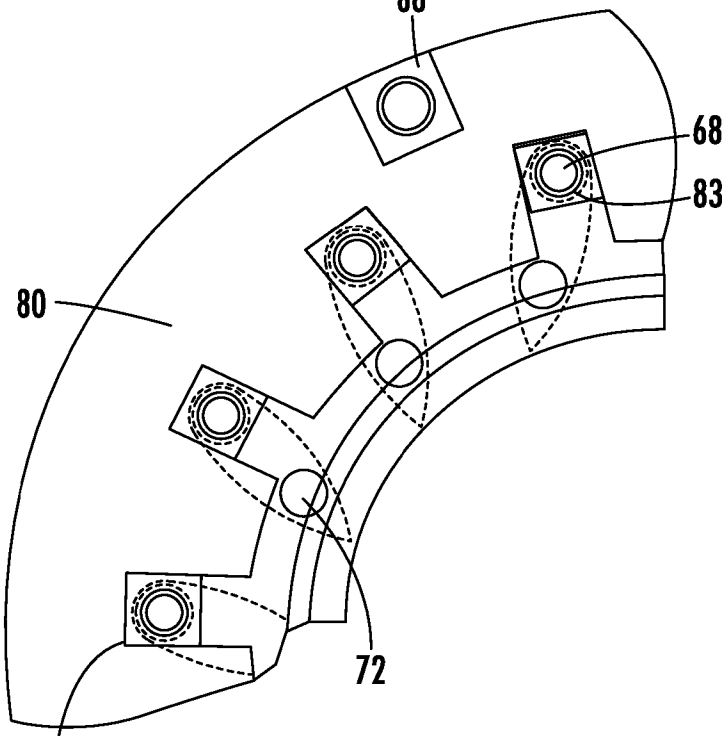
FIGS. 6A-B are views of a vane pack according to embodiments herein, showing the rotation of the vanes with rotation of a unison ring.
Figure 7A:
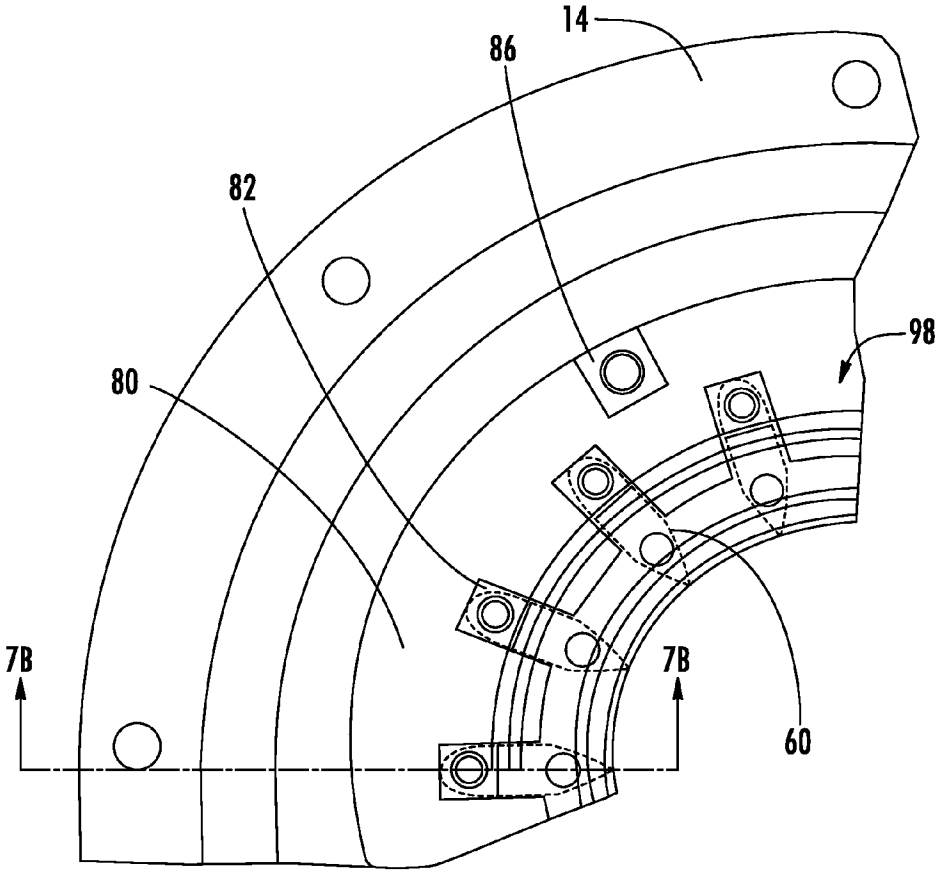

FIGS. 6A-B show a vane pack (100) configured according to embodiments herein. The unison ring (80) can be rotated relative to the UVR (26) and LVR (28), about the axis (88) of the turbocharger. As the unison ring (80) is rotated by the large sliding block (86) about the turbocharger axis (88), the axes of small sliding blocks (82) are also rotated relative to the turbocharger axis (88) causing rotation of the vane post (72) about the rear vane pivot (61*b*) (the bolt (72) and spacer/bushing (74)), altering the angle of attack of the vane (60), and changing the flow of exhaust gas to the turbine wheel (10). With reference to FIGS. 7A-B, a manner of assembling the vane pack (100) according to embodiments herein will now be described. A plurality of bolts (72) can be provided. The bolts (72) can include a head (90) at one end. Each of the bolts (72) are fitted into a respective one of a plurality of bores (91) formed in the LVR (28) such that the heads (90) of the bolts (72) are received in counterbores (92) and are substantially flush with or recessed from an outer surface (94) of the LVR (28).

A plurality of hollow spacers/bushings (74) can be provided. Each of the hollow spacers (74) can be placed over the bolts (72) such that the spacers (74) and bolts (72) protrude from the inner surface (40) of the LVR (28). The vanes (60) can be placed over the spacers (74) and bolts (72) such that they are received in the bore (70) of the vane (60) The vanes (60) can rotate about the axes (96) of the individual spacers (74) and bolts (72). An end of each spacers (74) can abut the inner surface (40) of the LVR (28)

A plurality of small sliding blocks (82) provided. Each small sliding block (82) can be fitted to a respective one of the vane posts (68). Each small sliding block (82) can include an aperture (83) formed therein to receive the vane posts (68). The unison ring (80) can be fitted to the small sliding blocks (82) such that each of the sliding blocks (82) is received in a respective one of the slots (84) provided in the unison ring (80).

The UVR (26) is slid over the plurality of bolts (72) so that the inner surface (38) of the UVR (26) abut an end of the spacers (74), thus determining and maintaining the distance between the inner surfaces (38, 40) of the vane rings (26, 28). The bolts (72) can be received in respective bores (93) formed in the UVR (26). The outer flange (98) of the UVR (26) can partially cover the small sliding blocks (82). Thus, once the UVR (26) is secured to the LVR (28), the sliding blocks (82) cannot slide off their respective vane posts (68) if the vane pack (100) is turned upside down. Nuts (102) can be fitted to each of the bolts (72) and secured. Now the UVR (26) can be located a set distance (determined and maintained by the spacers (74)) from the LVR (28), the vanes (60) are captured between the vane rings (26, 28). The small sliding blocks (82) can be captured under the flange (98) of the UVR (26), and the vane pack (100) can be readily transferred from the site of the vane pack assembly to the site of the turbocharger assembly without fear of the vane pack coming apart.

A spring member (104), such as a bellville washer, can be fitted to a flange on the top side of the UVR (26). A portion of a turbine housing closure (108) (e.g. an inward extending protrusion (106)) can abut the spring member (104) so as to apply a force to the spring member (104) and thus to the upper vane ring (26). This spring member (104) not only seats the vane pack (100) in the turbine housing (14), but also provides a seal against the escape of relatively high pressure exhaust gas and soot which has escaped through the UVR (26), unison ring (80), and small turning blocks (82),In some instances, the spring member (104) can be replaced by alternative means for retaining the vane pack (100) in the turbine housing (14), such as bolts or studs or a snap ring axially constraining the vane pack to the turbine housing. In such case, the sealing function of the spring member (104) could be replaced by a suitable seal, such as a labyrinth seal, thereby minimizing the escape of pressurized exhaust gas and soot.

It will be appreciated that embodiments of a vane pack assembly described herein can provide numerous benefits. For instance, the configuration can permit ease of final assembly. Further, the assembly can use relatively inexpensive parts and avoids the use of parts made from exotic materials. Further, the vane pack is configured to avoid the need for welding of the parts of the assembly. Moreover, the vane pack assembly removes the spacers from the exhaust gas flow path, thereby avoiding vortex shedding issues the affect current vane pack designs. These and other benefits can be realized with a vane pack configured according to embodiments herein.

The terms "a" and "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language).

Aspects described herein can be embodied in other forms and combinations without departing from the spirit or essential attributes thereof. Thus, it will of course be understood that embodiments are not limited to the specific details described herein, which are given by way of example only, and that various modifications and alterations are possible within the scope of the following claims.

The invention claimed is:

1. A vane pack (100) for a variable geometry turbocharger comprising:

an upper vane ring (26) and a lower vane ring (28);

a plurality of vanes (60) operatively positioned between the upper and lower vane rings (26, 28), each vane (60) having opposing cheek surfaces (65) with a vane post (68) protruding from one of the cheek surfaces (65), a bore (70) extending through each vane (60);

a plurality of fasteners (72) having a head (90) at one end, each fastener (72) extending through the upper and lower vane rings (26, 28) and the bore (70) of a respective one of the vanes (60); and a plurality of spacers (74) for maintaining a minimum distance between the upper and lower vane rings (26, 28), each spacer (74) being received in the bore (70) of a respective one of the vanes (60), the vanes (60) being pivotable about the vane post (68) or the fastener (72), whereby the spacers (74) are not located within the flow path between the upper and lower vane rings (26, 28).

2. The vane pack of claim 1, wherein the head (90) of the fasteners (72) is received in a counterbore (92) of the lower vane ring (28) so as to be substantially flush with or recessed from an outer surface (94) of the lower vane ring (92).

3. The vane pack of claim 1, further including a plurality of small sliding blocks (82), wherein each small sliding block (82) includes an aperture (83), wherein each small sliding block (82) receives a vane post (68) of a respective one of the vanes (60), and wherein at least a portion of each small sliding block (82) is operatively positioned between the vane cheek surface (65) and the upper vane ring (26).

4. The vane pack of claim 3, further including a generally annular unison ring (80) having a plurality of slots (84) provided therein, the unison ring (80) being positioned such that each small sliding block (82) is received in a respective one of the slots (84) in the unison ring (80).

5. The vane pack of claim 1, wherein an end of each fastener (72) is engaged by a nut (102) such that the upper vane ring (26), the lower vane ring (28) and the plurality of vanes (60) are clamped between the nut (102) and the head (90) of the fastener (72).

6. The vane pack of claim 1, further including:

a turbine housing closure (108); and a spring member (104) operatively positioned between the turbine housing closure (108) and the upper vane ring (26).

7. A vane pack (100) for a variable geometry turbocharger comprising:

an upper vane ring (26) and a lower vane ring (26);

a plurality of vanes (60) operatively positioned between the upper and lower vane rings (26, 28), each vane (60) having opposing cheek surfaces (65) with a vane post (68) protruding from one of the cheek surfaces (65), the vane (60) being pivotable about the vane post (68); and a plurality of small sliding blocks (82), wherein each small sliding block (82) includes an aperture (83), wherein the aperture (83) of each small sliding block (82) receives a vane post (68) of a respective one of the vanes (60), and wherein at least a portion of each small sliding block (82) is operatively positioned between a respective vane cheek surface (65) and the upper vane ring (26).

8. The vane pack of claim 7, further including a generally annular unison ring (80) having a plurality of slots (84)

provided therein, the unison ring (80) being positioned such that each small sliding block (82) is received in a respective one of the slots (84) in the unison ring (80).

9. The vane pack of claim 8, wherein a portion of the unison ring (80) is operatively positioned between the vane cheek surface (65) and an outer flange (98) of the upper vane ring (26).

10. The vane pack of claim 8, wherein an inner peripheral surface (81) of the unison ring (80) is substantially adjacent to the upper vane ring (26), whereby sliding movement of the small blocks (82) in a respective slot (84) is constrained in a radially inner direction by the upper vane ring (26).

11. The vane pack of claim 7, further including:

a turbine housing closure (108); and a spring member (104) operatively positioned between the turbine housing closure (108) and the upper vane ring (26).

12. A method of assembling a vane pack (100) for a variable turbine geometry turbocharger comprising:

providing a lower vane ring (28) having a plurality of bores (91) formed therein;

providing a plurality of elongated fasteners (72) having a head (90) at one end;

inserting a fastener (72) into a respective one of the bores (91) in the lower vane ring (28) such that the head (90) engages the lower vane ring (28) and the fastener (72) extends from an inner surface (40) of the lower vane ring (28);

placing a hollow spacer (74) over the extending portion of the fastener (72) such that an end portion of the spacer (74) engages the inner surface (40) of the lower vane ring (28) and such that a portion of the fastener (72) extends beyond the opposite end of the spacer (74); and providing a plurality of vanes (60) having opposing cheek surfaces (65) with a vane post (68) protruding from one of the cheek surfaces (65) and a bore (70) extending through the vane (60), the spacer (74) and a portion of the fastener (72) being received in the bore (70).

13. The method of claim 12, further including:

providing a plurality of small sliding blocks (82), each of the small sliding blocks (82) including an aperture (83); and inserting each small sliding block (82) onto a respective one of the vane posts (68), such that each vane post (68) is received in a respective the aperture (83).

14. The method of claim 13, further including:

providing a generally annular unison ring (80) having a plurality of slots (84) provided therein;

positioning the unison ring (80) such that each small sliding block (82) is received in a respective one of the slots (84) in the unison ring (80).

15. The method of claim 14, further including:

providing an upper vane ring (26) having a plurality of bores (91) formed therein, the upper vane ring (26) having an outer flange (98);

positioning the upper vane ring (26) such that a portion of each fastener (72) is received in a respective bore (93) in the upper vane ring (26) and such that the small sliding blocks (82) are positioned between one of the vane cheek surfaces (65) and the flange (98) of the upper vane ring (26).

16. The method of claim 15, wherein an end portion of the fastener (72) extends beyond an outer surface of the upper vane ring (26), and further including:

engaging the end portion with a nut (102) such that the upper vane ring (26), the lower vane ring (28) and the plurality of vanes (60) are clamped between the nut (102) and the head (90) of the fastener (72).

* * * * *